United States Patent [19]

Baron et al.

[11] Patent Number: 4,787,875

[45] **Date of Patent: * Nov. 29, 1988**

[54] WATER SPROUTING INFLATABLE BOP BAG

[75] Inventors: William J. Baron, New York; Marie F. Gredel, Middle Village, both of N.Y.

[73] Assignee: Kid Biz, Inc., New York, N.Y.

[ * ] Notice: The portion of the term of this patent subsequent to Apr. 7, 2004 has been disclaimed.

[21] Appl. No.: 34,382

[22] Filed: Apr. 6, 1987

Related U.S. Application Data

[63] Continuation-in-part of Ser. No. 772,442, Sep. 4, 1985, Pat. No. 4,655,722.

[51] Int. Cl.[4] ..... A63H 3/06; A63H 13/18; B05B 15/00

[52] U.S. Cl. ..... 446/226; 446/325; 239/289

[58] Field of Search ..... 446/226, 325, 156, 152, 446/153, 154, 199, 211, 224; 239/211, 275, 289, D1

[56] References Cited

U.S. PATENT DOCUMENTS

| | | | |
|---|---|---|---|
| 1,918,874 | 7/1933 | Shannahan | 446/154 |
| 2,968,120 | 1/1961 | Reed | 239/211 X |
| 3,509,584 | 5/1970 | Sable | 446/153 X |
| 4,078,792 | 3/1978 | Arato | 239/211 X |
| 4,144,670 | 3/1979 | Gearhart | 446/156 |
| 4,205,785 | 6/1980 | Stanley | 446/211 X |
| 4,235,378 | 11/1980 | Melin et al. | 446/153 X |
| 4,268,030 | 5/1981 | Richards | 446/226 X |
| 4,550,876 | 11/1985 | Kulesza et al. | 239/211 |
| 4,655,722 | 4/1987 | Baron et al. | 446/226 |

*Primary Examiner*—Robert A. Hafer
*Assistant Examiner*—D. Neal Muir
*Attorney, Agent, or Firm*—Charles E. Baxley

[57] ABSTRACT

A water spouting bop bag includes an inflatable housing having ballast in a lower portion thereof. A spray head is connected at the top of the housing and water is delivered thereto from a garden hose via a tube in the housing. With water spouting from its top, a child punches the bop bag from an initial upright position, so as to tilt the water spout onto another player. The weight of the ballast restores the bop bag (and the water spout) to the initial upright position.

10 Claims, 2 Drawing Sheets

WATER SPROUTING INFLATABLE BOP BAG

CROSS REFERENCE

This application is a continuation-in-part application with respect to copending U.S. patent application Ser. No. 772,442 filed Sept. 4, 1985 and which will have issued as U.S. Pat. No. 4,655,722 on April 7, 1987.

BACKGROUND OF THE INVENTION

This invention relates to a gas inflatable punching bag toy known as a "Bop bag". A bop bag stands freely on a surface or it floats in water, and it is ballasted so that when it is struck by a child (of any age) it is displaced from an initial stable upright position, then the weight of the ballast returns the bop bag to said initial position. Accordingly, the bop bag has a basic function as a rebounding punching bag, whereby it offers the child excitement and presumably allows the child to act out aggressions. In performing its basic function, the bop bag rolls randomly in response to punches by the child.

Bop bags have been around for quite a while and they are popular toys, so competition among designers of bop bags is keen. Improvements have added attractive features to bop bags, typically they are decorated with characters, friendly or unfriendly. By way of extreme, U.S. Pat. No. 4,268,030 to Mr. Lawrence Richards disclosed a bop bag which includes front and rear panels and an intermediate panel spaced medially substantially equidistant from the front and the rear panel. The front and intermediate panels of Richards' bop bag are formed of a transparent material, while the rear panel is opaque. Images are imprinted on the internal surfaces of the three panels, the images cooperating with each other to produce an illusion of three dimensions and a composite image which continuously changes with different angles of observation. The Richards patent is cited here to illustrate a highly advanced stage of bop bag gimmickery. Even with highly motivated efforts, however, design improvements in bop bags have been limited, because the bop bag had been thought of in the trade to be a free standing structure. Since it has to be able to roll randomly, the bop bag was considered by toy designers to be isolated unto itself.

The present invention recognizes how much fun it is for children to control a shower of water onto each other, so the present inventors sought to convert the bop bag into a water spray directing toy. This conversion entailed a hose connection which, it had generally been thought, would incline the bop bag out of its stable initial upright position and would distort the random rolling which is so necessary for basic bop bag action.

SUMMARY OF INVENTION

The present invention teaches connection of a water hose to a bop bag in the lower region of the bop bag and delivery of water to the vicinity of the top of the bop bag by means of an internal tube. With proper ballasting, the hose connection surprisingly does not incline the bop bag unduly in its initial stable position and the hose connection does not detract unduly from the random rolling, even when the bop bag is used floating in a swimming pool.

Prior art bop bags usually were sand ballasted. The sand burdened the toy with additional weight and necessitated packaging of the toy in a corrugated box. Thus it is a further offering of the present invention to use water for the ballast. By this expedient the weight of the toy is reduced and, more importantly, the toy can be packaged flat in a vinyl bag for rack display. This invention also provides a specially designed flat ballast plug assembly in the base of the bop bag, so as not to disturb the random rolling action. The ballast plug assembly preferably is made leak resistant, to obviate accidental leakage of water in the event the stopper is dislodged from its seat.

Accordingly, the present invention addresses limitations and problems of prior art bop bags in a particularly useful, novel and unobvious way. A bop bag is fashioned with a housing that has an upper gas inflatable chamber and a lower ballast chamber. Water serves conveniently as the ballast. A water hose connection is fitted to penetrate the housing toward the bottom of the bop bag, more specifically in the gas chamber, and the water is delivered via an internal tube to a spray head situated in the vicinity of the top of the bop bag. When a child punches this bop bag, he (or she) not only knocks it from its initial stable position, but he (or she) also redirects an issuing water spout perhaps onto another player. The water spout coacts with basic bop bag action in a lively, exciting way to add to enjoyment of the children so playing. With the water spout, the bop bag becomes a focus for play by more than one child, so children are encouraged to play together. These playing children also tend to remain in close proximity of the bop bag, easily supervised by a parent or baby sitter.

A basic object of this invention is to provide a gas inflatable bop bag that stands freely on a surface or floats in water and has ballasting means. When the bop bag is displaced from an initial stable position, the weight of the ballast returns it thereto.

An additional object particularly to this invention is to provide the bop bag with a water spout issuing preferably from its top. The water spout goes in various directions as the bop bag is punched, thereby enhancing fun of children playing with the toy.

Still an additional object particular to this invention is to make bop bags attractive to be played with by a plurality of children at the same time, so that children are encouraged to play with each other.

Still an additional object particular to this invention is to provide a free standing toy which remains in place, and with children attracted thereto, so that the children are more easily supervised by a parent or baby sitter.

Still an additional object particular to this invention is to provide a bop bag with water ballasting, so that sand need not be involved.

Still an additional object particular to this invention is to provide a water ballasted bop bag retaining a rounded bottom to assure an upright initial stable position and random rolling action on a flat surface.

Still an additional object particular to this invention is to provide a bop bag of generally pineapple shape which tends to resist distortion when the bop bag is punched.

Still an additional object particular to this invention is to provide a bop bag which is easy and inexpensive to manufacture, transport and display and which is suited well otherwise to its intended use.

BRIEF DESCRIPTION OF THE DRAWINGS

The foregoing and other features and advantages will appear more fully and fuller understanding of the invention will be realized by referring to a description of a preferred embodiment of this invention which follows, viewed in conjunction with drawings which accompany this specification, in which same identifying numerals are used throughout the various views, and in which.

DESCRIPTION OF PREFERRED EMBODIMENT

Figure 1:
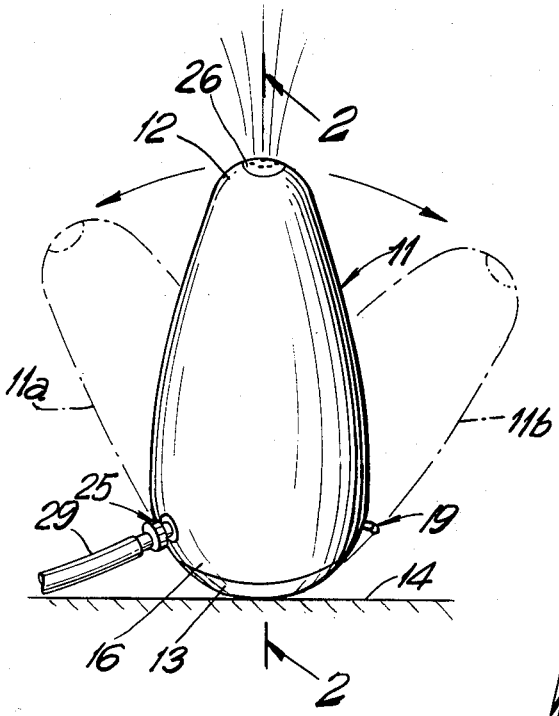
FIG. 1 is an elevational view of a bop bag according to this invention, showing the initial upright stable position of the bop bag in full lines and representative unstable positions in phantom lines.

Referring to FIG. 1, a bop bag toy generally includes a housing 11, which is shown as being elongated with a generally pineapple shape and having a top 12 and a rounded bottom 13. The pineapple shape housing 11 is preferred over a cylindrical body punching bag shape which would be awkward and unstable as it moves and which would be suggestive of prize fighting. Housing shapes with heads, necks and shoulders distort unduly when they are punched, so those housing shapes would be less desirable than the preferred ojive shape. The housing 11 is adapted to be supported on a flat surface 14 or floating (not shown) typically in a swimming pool. The housing 11 is ballasted so that it assumes a stable upright position shown in full lines in FIG. 1. Also shown in FIG. 1 are various unstable positions 11*a*, 11*b* into which the housing is punched by a child (not shown). The unstable positions are shown in phantom lines.

Figure 2:
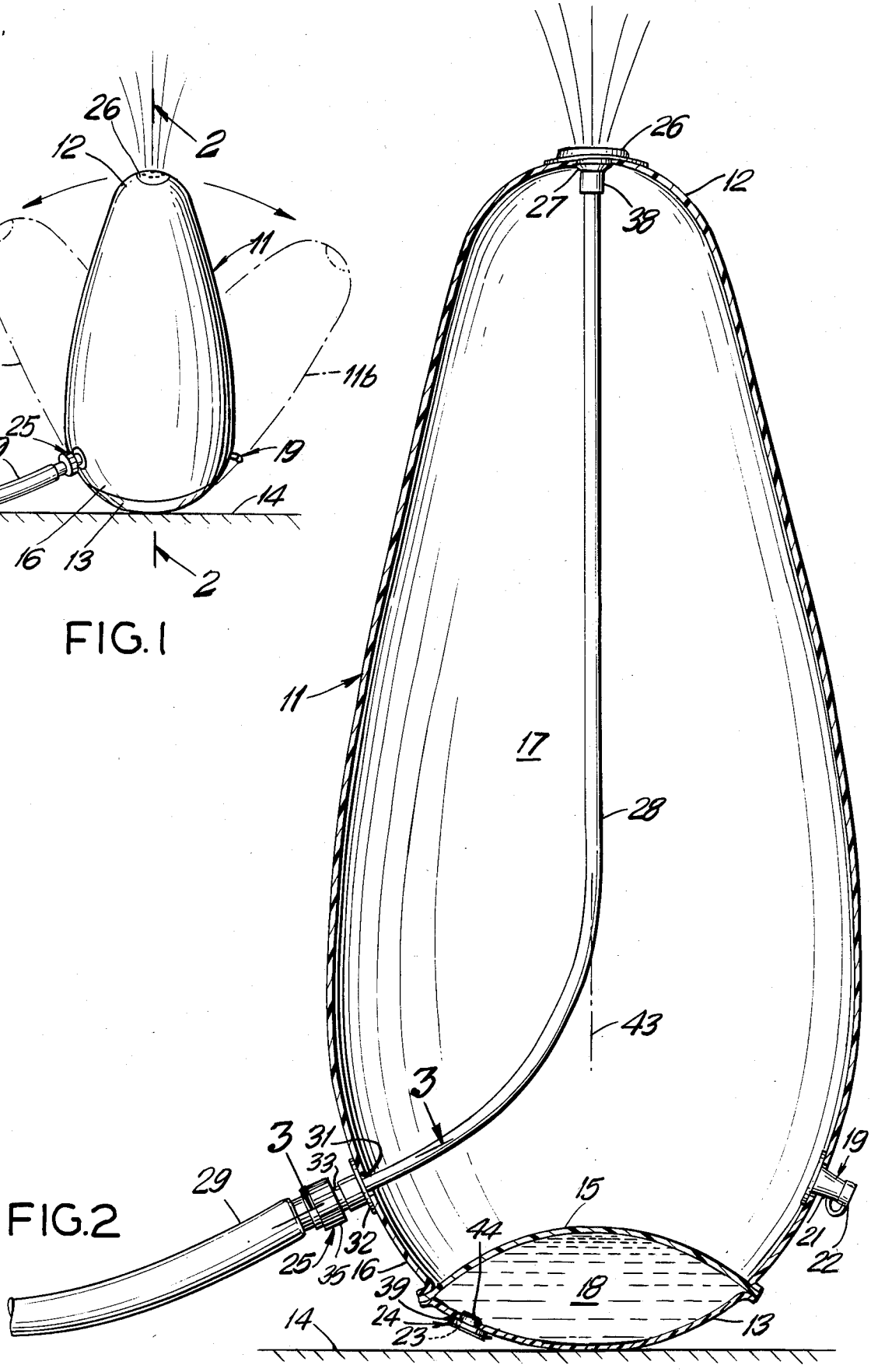
FIG. 2 is an enlarged sectional view taken along line 2—2 of FIG. 1 looking in the direction of the arrows.

As seen best in FIG. 2, the housing 11 is provided with a diaphragm 15 fitted in sandwiched heat sealed engagement about the wall 16 of the housing 11 to divide the housing 11 into an upper gas compartment 17 and a lower ballast compartment 18. Inflation means are shown as a conventional air valve generally designated 19 made of a polyvinyl chloride nipple 21 heat sealed to the vinyl housing 11 and having the usual hinged stopper 22. A gas (usually air) is introduced via the air valve 19 under pressure into the gas compartment 17 to inflate the bop bag. Ballast is introduced via a water port 23 having a flat water plug assembly generally designated 24. Before the bop bag is inflated, the water port 23 can be located conveniently under a sink faucet (not shown) for filling ballast compartment 18 with water. Although water is the preferred ballast for carrying out this invention, because its freedom from shear stresses allows it to compensate for a tendency of the hose to tilt the housing, other ballasts (such as sand, not shown) could be employed in the bop bag of this invention. The weight of the ballast tends to restore the housing 11 to its initial upright position shown in full lines in FIG. 1, after the housing has been knocked into one or more unstable positions 11*a* or 11*b* (shown in FIG. 1 by phantom lines) by a child punching the housing 11.

According to the present invention, the housing 11 is provided with water inlet means shown as a garden hose coupling generally designated 25. Water outlet means are shown to include a spray head 26 connected in the top 12 of the housing 11 by means of a gasket fitting 27. The spray head 26 is connected in flow series to the garden hose coupling 25 via water delivery means shown in FIG. 2 as a tube 28. The water outlet means need not necessarily be the spray head 26 and it could be located in a variety of places on (or in close association with) the housing 11 within the teaching of this invention, so long as the water outlet means do not prevent basic operation of the bop bag.

Figure 3:
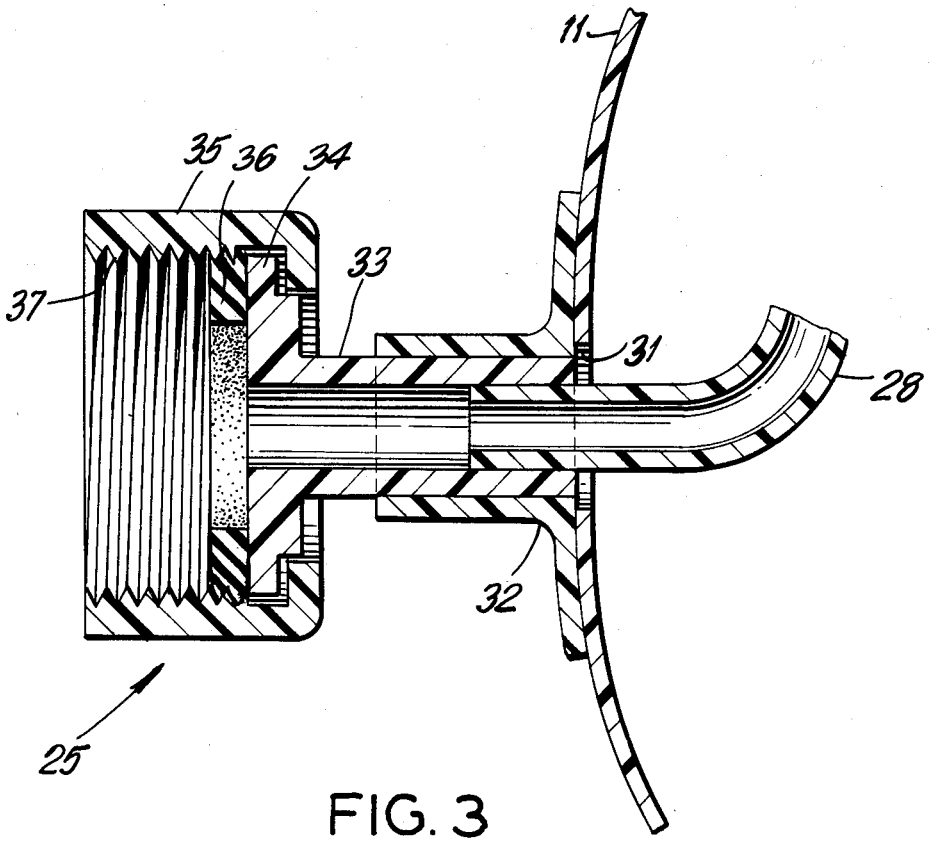
FIG. 3 is an enlarged sectional view taken along line 3—3 of FIG. 2 looking in the direction of the arrows and showing details of the water hose connection.

As best seen in FIGS. 2 and 3, a garden hose 29 delivers water under pressure to the tube 28. The housing 11 preferably is made of polyvinyl chloride sheet which defines a hole 31. As seen in FIG. 3, a nipple 32 is made of molded polyvinyl chloride and is heat sealed to the vinyl sheet. A stem 33 is made of acetal butyl styrene and is glued into the nipple 32 using a vinyl glue. The stem 33 opens into a flange 34 that is inserted into an acetal butyl styrene sleeve 35 provided with an elastomeric washer 36. The sleeve 35 being female has threads 37 to accept a male garden hose thread in watertight engagement therein. Vinyl tube 28 is engaged in stem 33 by means of vinyl glue.

At the top 12 of the housing 11, as seen best in FIG. 2, the vinyl tube 28 is heat sealed into another sleeve 38 of the polyvinyl chloride fitting 27 and the spray head 26 is heat sealed, glued or connected otherwise with the polyvinyl chloride fitting 27.

It is preferable to have the garden hose coupling penetrate the housing 11 into the gas compartment 17, so that the diaphragm 15 need not be penetrated by the tube 28. The air inlet valve 19 is positioned remote from the top 12 of the housing 11, so that it will not strike a child when the bop bag is hit or rebounds on its own to its initial upright position.

Figure 4:
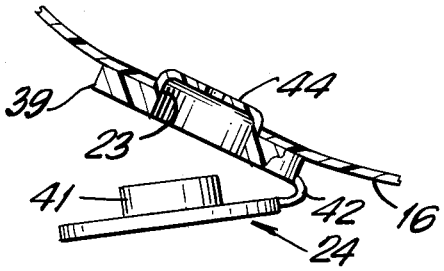
FIG. 4 is an enlarged sectional view showing details of the water ballast plug with leak resistant features.

As seen best in FIG. 4, the ballast introduction means comprises the water port 23 formed in the vinyl housing wall 16. The flat plug assembly generally designated 24 comprises a polyvinyl chloride seat 39 which is heat sealed to the housing wall 16. A stopper 41 is connected to the seat 39 by means of a flexible hinge 42 and the stopper 41 penetrates into an opening 23 of the seat 39. The water plug assembly 24 is organized flat and it is spaced from the upright axis 43 of the housing 11, so as to interfere as little as possible with random rolling of the housing 11 over its rounded bottom 13. The flat water plug seal 39 has flaps 44 formed thereon to project into the ballast compartment 18 so as to obviate accidental leakage of water, in the event stopper 41 is dislodged from its seat 39.

If desired, the bop bag according to this invention could be used indoors, presumably without the water spout being in play. Where the water spout is in play, outdoor use is contemplated. The bop bag also may be immersed in a swimming pool or in some other body of water. It is contemplated further that various fins, tentacles and/or other appendages may depend from the housing 11, so long as they do not interfere with basic bop bag action. If desired, water can be sprayed from such fins, tentacles or appendages.

Although only one presently preferred embodiment of this invention has been shown and described, it will be seen by those skilled in the art of designing and manufacturing inflatable toys that modifications and variations of the preferred embodiment can be foreseen, while still coming within the spirit and scope of the invention which is set forth in the claims.

We claim:

1. A bop bag comprising:

an elongated housing generally having an upper end and a lower end and having an upper gas compartment and a lower ballast compartment;

inflation means penetrating the housing in the gas compartment at a location closer to the lower end than to the upper end for introducing air under pressure into the gas compartment to inflate the bop bag;

means for introducing ballast into the ballast compartment whereby when the inflated bop bag is displaced from an initial stable upright position the ballast returns it thereto; the housing provided with water inlet means in proximity with the lower end and disengageably coupleable to a supply of water under pressure and water outlet means in proximity with the upper end arranged to spout the water from the housing; and water delivery means within the housing for delivering a flow of the water from the water inlet means to the water outlet means.

2. The bop bag of claim 1 with the housing substantially pineapple shaped except for a rounded bottom.

3. The bop bag of claim 2 with the water delivery means being a tube.

4. The bop bag of claim 3 with the water outlet means being a spray head.

5. The bop bag of claim 4 with the ballast also being water.

6. The bop bag of claim 5 with the water inlet means penetrating the housing via the gas compartment remote from the upper end.

7. The bop bag of claim 1 with the lower end adapted to be supported on a substantially flat surface.

8. The bop bag of claim 1 with the lower end adapted or immersion in water.

9. The bop bag of claim 7 with the means for introducing ballast being a flat plug assembly so that the bop bag is enabled to rock randomly on the flat surface.

10. The bop bag of claim 7 with the flat plug assembly having at least one flap projecting into the ballast chamber.

* * * * *